United States Patent [19]

Smith et al.

[11] 4,256,304

[45] Mar. 17, 1981

[54] BASEBALL

[75] Inventors: Tommy L. Smith, Aurora; Edward G. Dierickx, West Linn; Walter B. Schade, Jr., Portland; Leslie A. Pete, Central Point, all of Oreg.

[73] Assignee: Athletic Training Equipment Company, Clackamas, Oreg.

[21] Appl. No.: 97,227

[22] Filed: Nov. 27, 1979

[51] Int. Cl.[3] ..... A63B 37/00

[52] U.S. Cl. ..... 273/60 B; 124/78; 273/DIG. 8; 273/232

[58] Field of Search ..... 273/60 R, 60 A, 60 B, 273/62, 218, 58 J, 58 K, 26 R, DIG. 8, 232; 124/78

[56] References Cited

U.S. PATENT DOCUMENTS

| | | | |
|---|---|---|---|
| 465,507 | 12/1891 | Windoes | 273/60 R |
| 1,345,904 | 7/1920 | Wishart | 273/58 J X |
| 3,730,919 | 5/1973 | McGinn | 260/2.5 AZ |
| 3,734,868 | 5/1973 | Uelzmann | 260/2.5 AM |
| 3,976,295 | 8/1976 | Heald | 273/60 R |
| 3,979,126 | 9/1976 | Dusbiber | 273/218 |

OTHER PUBLICATIONS

"The Aerodynamics of Golf Balls", John M. Davies, Journal of Applied Physics, vol. 20, No. 9, Sep., 1949, pp. 821–828.

Golf Ball Aerodynamics, P. W. Bearman and J. K. Harvey, Aeronautical Quarterly, May, 1976, pp. 112–122.

*Primary Examiner*—George J. Marlo

*Attorney, Agent, or Firm*—Klarquist, Sparkman, Campbell, Leigh, Whinston & Dellett

[57] ABSTRACT

A baseball suitable for continuous use in a pitching machine comprises a molded, resilient polyurethane foam sphere having a type A-2 shore durometer hardness of less than about eighty to eighty-five. The sphere has a smooth polyurethane surface skin, with the surface of the sphere being provided with a regular pattern comprising a multiplicity of cup-like or hemispherical depressions substantially covering the surface. The baseball has the advantage of durability as well as the advantage of being formed economically in one operation from a homogeneous composition. The cup-like depressions enable the ball to travel greater distances than would be expected for the resilient material, and enhance the accuracy with which the ball can be pitched, bringing the ball substantially within the range of initial performance of a conventional or regulation baseball. The ball is pitched in a pitching machine providing backspin and the depressions appear to cause turbulent airflow enhancing lift and drag factors on the ball as well as stabilizing its flight path. The ball resilience further enhances the ease with which it is manufactured since the ball can be easily removed from a simple mold despite the presence of mold projections used to form the aforementioned depressions.

10 Claims, 9 Drawing Figures

FIG. 3
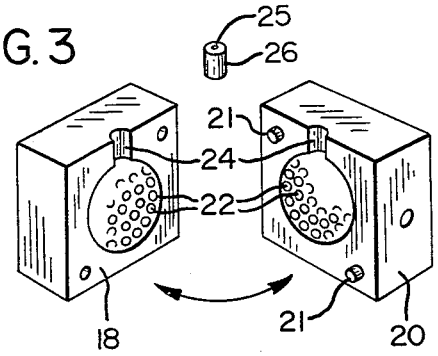
FIG. 4
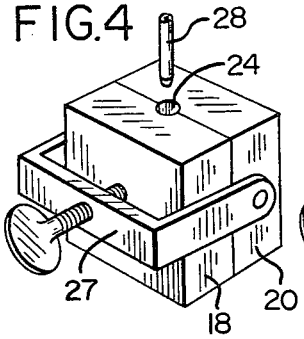
FIG. 5
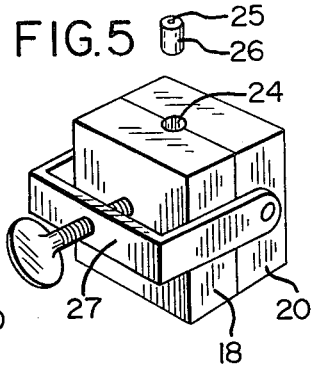
FIG. 6
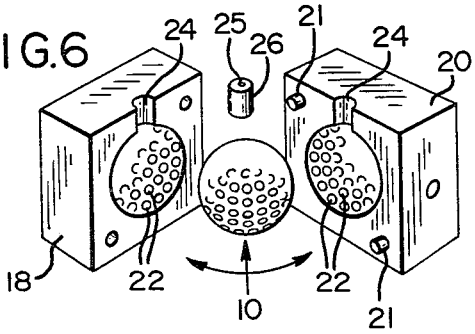
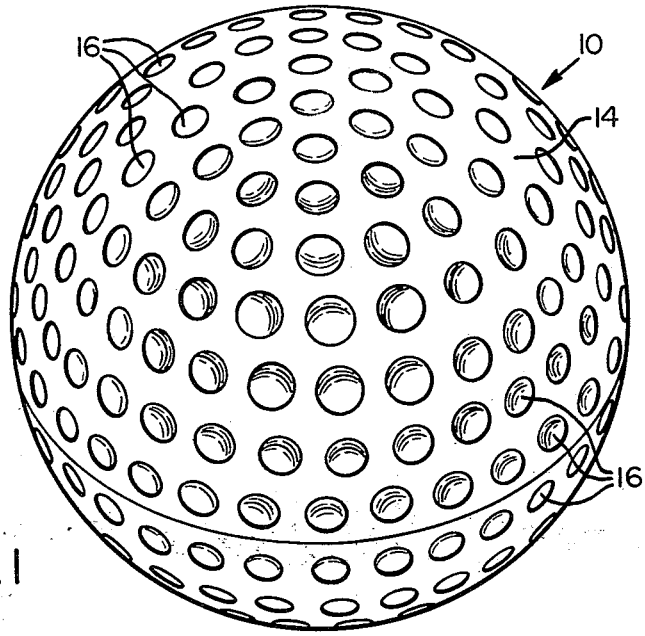
FIG. 1
FIG. 2
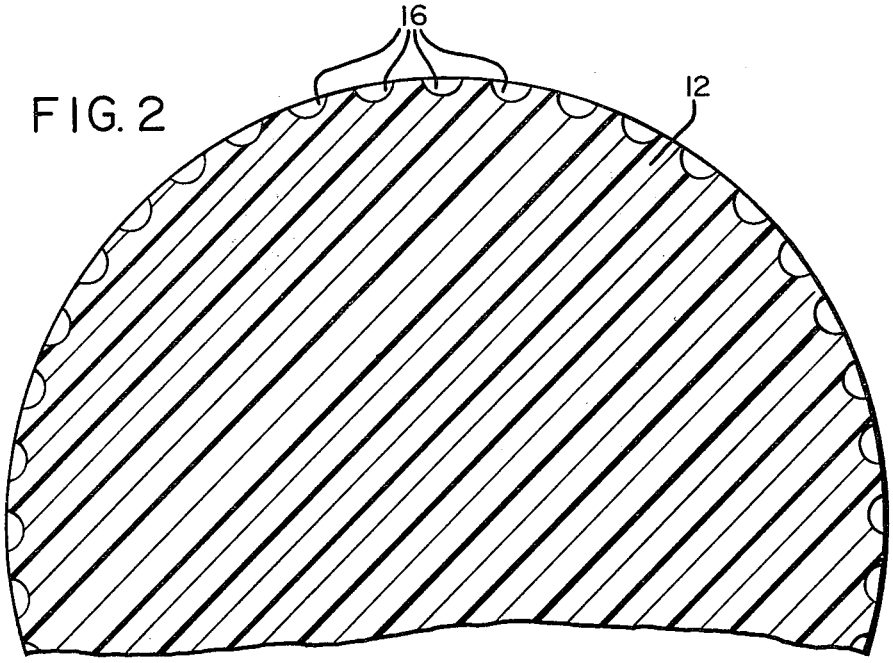

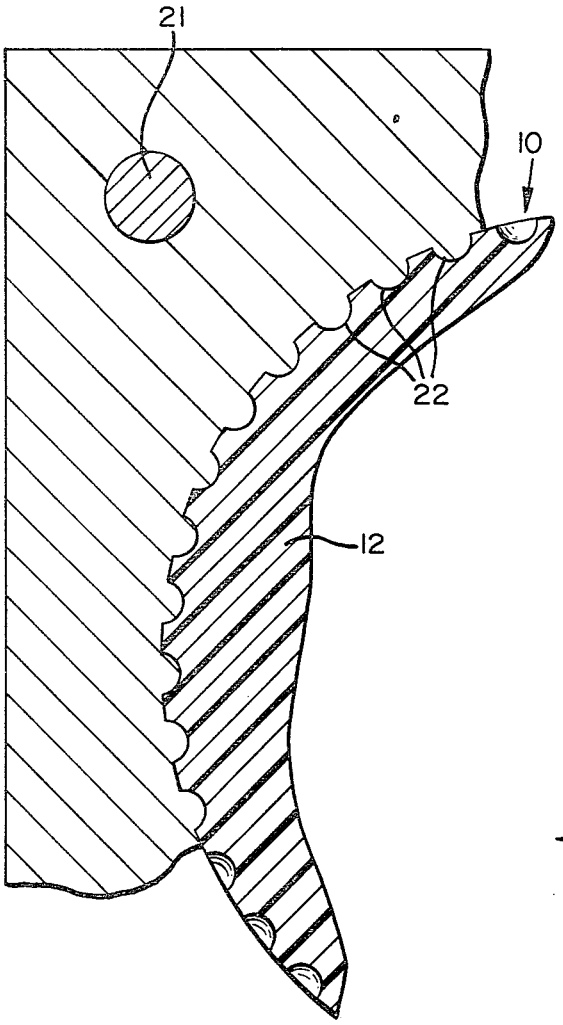
FIG. 7
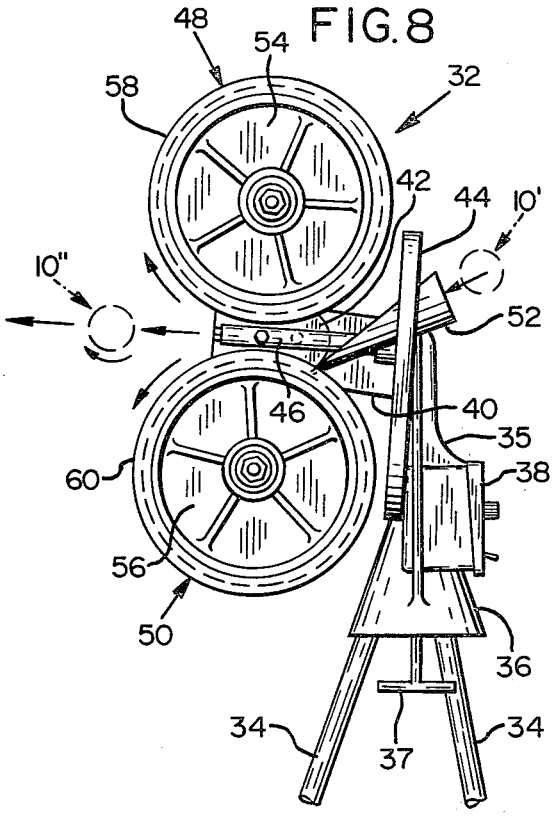
FIG. 8
FIG. 9
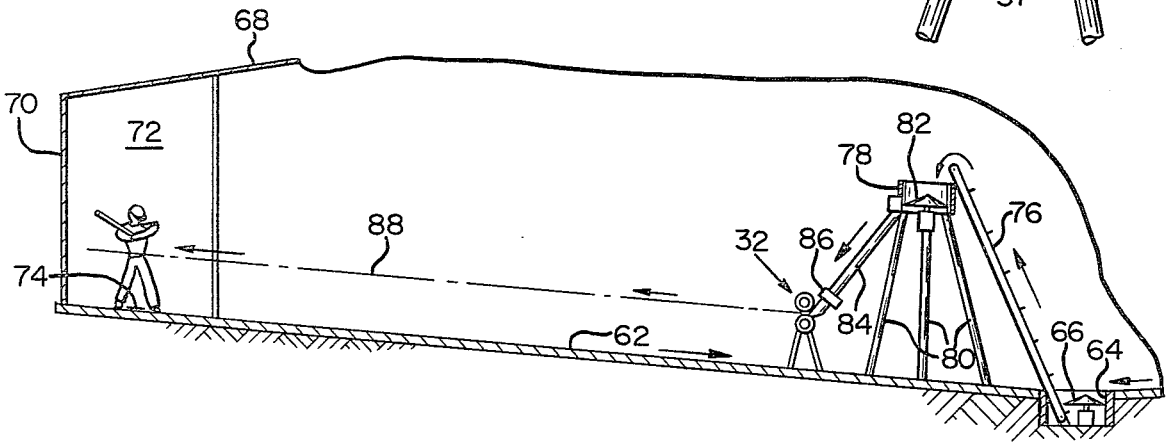

BASEBALL

BACKGROUND OF THE INVENTION

The present invention relates to baseballs and a method of manufacturing and pitching the same, and more particularly to baseballs economically formed of durable material while nonetheless having performance characteristics at least equivalent to those of a regulation ball.

Pitching machines as employed in batting ranges, or in general for batting practice, customarily dispense large numbers of baseballs which are collected and returned to the pitching machines for reuse. In the batting range disclosed in copending Smith application Ser. No. 27,290, now U.S. Pat. No. 4,220,331, entitled "Baseball Batting Range Retrieval System", a conveying system is employed for returning batted baseballs to a plurality of pitching machines. A suitable individual pitching machine is described in Smith application Ser. No. 850,472, now U.S. Pat. No. 4,197,827, entitled "Coacting Wheel Ball Projecting Device". Since a large number of baseballs are continuously used, the expense of providing baseballs can become a major consideration. Another consideration relates to pitching accuracy, i.e., a suitable target range so the pitching machine can deliver a baseball in the strike zone without danger to the batter. Ideally, a good quality regulation baseball can be delivered by a pitching machine such as described in the aforementioned application with considerable accuracy. However, wear and tear on the baseballs with continuous use makes frequent replacement necessary. Not only do balls completely wear out but also the accuracy of a baseball is affected by wear and by the accumulation of foreign particles, for example dirt from its surroundings, such that theoretical or initial pitching accuracy achievable with a new ball cannot be maintained. Furthermore, a conventional ball tends to be orientation sensitive whereby conveyor feeding of balls with random orientation can affect the pitching accuracy since the stitching on the ball may engage the pitching machine wheels differently on successive pitches. Also, conventional balls tend to hang up in conveyors and don't roll down conveyor troughs exceptionally well because of the friction of the exterior covering between balls and because of the stitching employed. Of course, wear of the balls also aggravates this problem. It would be of advantage to provide an economically formed baseball of homogeneous material such as plastic so as to reduce the cost of replacing baseballs.

Smooth plastic balls have been employed with pitching machines, e.g. in batting ranges, but hit the target area poorly. They also tend to be slippery and hard to handle, especially when wet. Plastic balls provided with simulated seams molded into the exterior are also found to be inaccurate and the seams cause the balls to be orientation sensitive in pitching machines. Furthermore, plastic balls made to be identically similar to baseballs as regards hardness, weight, etc., do not wear well, further aggravating the problem of pitching inaccuracy and necessitating replacement.

In one instance, a plastic ball has been disclosed as formed with a urethane interior and a conventional baseball outer covering layer (U.S. Pat. No. 3,976,295), but this construction renders the ball more expensive than a plastic ball while also having the problems associated with a regulation baseball. Although it has been suggested such a ball need not be provided with the conventional baseball covering layer, nevertheless the suggested underlying plastic material is found to wear poorly, having the problems associated with other prior art plastic balls. In the case of the urethane material employing water as a blowing agent, the ball has a large proportion of urea tending to make the ball somewhat rigid. Consequently, wear and useful lifetime as well as accuracy would be inhibited if the ball were not covered. Hollow plastic balls have also been used, but are not well adaptable for use in a pitching machine because of excessive compressibility.

A more resilient and tougher ball would be preferable from the standpoint of wear and life expectancy, but such a ball would ordinarily not have the characteristics of a regulation baseball since it would not be expected to travel as far or as well as a harder ball.

SUMMARY OF THE INVENTION

In accordance with the present invention, a baseball is provided having the general characteristics of a regulation baseball while exhibiting greater durability and pitching accuracy over an extended period of use. The ball according to the present invention has been found to be highly suitable for use in pitching machines as well as for conventional baseball practice. A baseball according to the present invention comprises a molded, resilient polyurethane foam sphere of homogeneous composition and density throughout its cross section and having an interior cellular structure characterized by the multiplicity of gas enclosing cells, said sphere having a duraometer hardness of less than about eighty to eighty-five, with a hardness of about seventy-five being preferred. The sphere has a smooth polyurethane surface skin, and the surface is provided with a regular pattern comprising a multiplicity of round, cup-like depressions each of which is small in diameter as compared with the diameter of the sphere. For example, the sphere diameter is between two and seven-eighth inches and three inches, while the depression diameter is on the order of one-tenth to one-twentieth of the diameter of the sphere. The depth of the depressions is suitably on the order of one-twentieth to one-fortieth the diameter of this sphere. The cup-like depressions substantially cover the exterior surface of the sphere such that the spacing between depressions is comparable with the diameter thereof to present substantially the same aspect of surface depression configuration for any direction of travel for said sphere through the air, with said smooth surface skin extending into the depressions.

It is found the ball according to the present invention, being more resilient and tougher than the usual plastic or even regulation baseball, has the advantages of durability and long life as well as the advantage of being formed economically in one operation from a homogeneous composition. The cup-like depressions enable the ball to travel greater distances than would be expected for the resilient material, while maintaining the accuracy with which the ball can be pitched to a target, bringing the ball substantially within the range of initial performance of a conventional regulation baseball despite the more resilient and durable material from which the ball according to the present invention is formed. The ball is suitably pitched in a pitching machine providing backspin. Apparently the depressions cause more turbulent airflow about the ball during flight, tripping boundary layers, and enhancing lift and drag factors on the ball such that the ball is pitched farther and more accurately by a pitching machine or the like. Moreover, the performance in regards to accuracy does not seem to be as much affected by wear or by the ball's picking up moderate amounts of foreign material as would be the case with a regulation baseball.

The depressions in the ball thus enable the ball to be made with greater resilience and toughness and hence durability since the depressions enable the resilient ball to travel as far and at least as accurately as a harder baseball. Moreover, the resilience of the ball in turn enables formation of cup-like or semi-spherical depressions by allowing removal of such a ball from a mold which would be difficult or impossible in the case of a harder material. For example, a harder urethane would tear from the mold under these circumstances rather than being easily removable.

Although shallow depressions substantially in the form of superficial indentations have been used heretofore in the case of golf balls, golf balls are made from different materials and have different characteristics. They are harder and travel faster, and normally are formed from a non-homogeneous material rather than being formed in one molding operation. The deeper, cup-like depressions found suitable for the baseball according to the present invention also present a significant problem with regard to mold release of the one-piece, molded object, not present in the case of golf balls.

It is accordingly an object of the present invention to provide an improved baseball having enhanced durability.

It is another object of the present invention to provide an improved baseball characterized by improved sustained pitching accuracy.

It is a further object of the present invention to provide an improved and economical baseball adapted for use in batting ranges and with pitching machines.

It is another object of the present invention to provide an improved baseball characterized by a tough, resilient and homogeneous construction which nonetheless has flight and accuracy characteristics as well as other characteristics at least comparable with a regulation baseball.

It is another object of the present invention to provide an improved baseball adapted for easier conveying in an automatic ball pitching system.

It is another object of the present invention to provide an improved baseball which is less sensitive to the orientation with which it is pitched than conventional baseballs.

It is a further object of the present invention to provide an improved baseball adapted for easier handling when wet.

It is a further object of the present invention to provide an improved method of providing accurately directed pitched balls.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a perspective view of a baseball according to the present invention;

FIG. 2 is a cross section of the FIG. 1 ball taken through the center thereof;

FIG. 3 illustrates mold members for forming the baseball according to the present invention;

FIG. 4 illustrates a first step in forming said ball with said mold members;

FIG. 5 illustrates a second step in forming said ball;

FIG. 6 illustrates removal of said ball from said mold members;

FIG. 7 is a cross section partially broken away of one of said mold members;

FIG. 8 is a side view partially broken away illustrating projection of a ball according to the present invention by a pitching machine; and FIG. 9 is a vertical cross section, partially broken away, of a batting range employing such pitching machine.

DETAILED DESCRIPTION

Referring to the drawings and particularly to FIGS. 1 and 2, a baseball according to the present invention comprises a sphere 10 composed of a homogeneous body of polyurethane foam 12 having the same density throughout its cross section and having an interior cellular structure characterized by a multiplicity of tiny gas enclosing cells. The foam structure is uniform throughout except for the smooth surface skin. The sphere is resilient having a durometer hardness of less than about eighty to eighty-five on the type A-2 Shore durometer scale, and preferably a hardness of about seventy-five.

The sphere has a smooth polyurethane surface skin 14, and the surface of the sphere is provided with a regular pattern comprising a multiplicity of round, cup-like depressions 16 which are semi-spherical in shape, i.e. each of which defines a hemisphere, wherein the diameter of each such depression is small as compared with the diameter of the sphere. In particular, the diameter of each depression may vary from about 0.175 inches to 0.225 inches, while the depth of each depression is approximately half that, e.g. varying from approximately 0.075 to 0.125 inches. The preferred depression diameter is 0.2 inches while the depth is 0.1 inch. The baseball diameter is between two and seven-eighths inches and three inches. Consequently, it is seen the diameter of the depressions is on the order of one-tenth to one-twentieth the diameter of the sphere, and the depth of said depressions is on the order of one-twentieth to one-fortieth the diameter of the sphere.

The depressions are identical and substantially cover the exterior surface of the sphere such that the spacing between depressions is comparable to the diameter thereof. In particular, the spacing between depression perimeters is between a fraction and twice the diameter of said depressions to present substantially the same aspect of surface depression configuration for any direction of travel by the sphere through the air. The smooth polyurethane surface skin is uniform over the surface of the ball and extends into the said depressions.

The depressions in the surface of the baseball sphere are arrayed in regular rows about the sphere, and the total number of depressions is between two hundred and four hundred suitably. In the instance of the particular baseball manufactured, the total number of depressions is two hundred eighty-six. It should be emphasized that the sphere as shown in not the interior or core of a ball, but rather comprises the entire ball.

Since the material of this sphere is somewhat more resilient than the average regulation baseball and certainly tougher and more resilient than other plastic baseballs thereby enhancing the durability and wearability of the ball, it might be thought the travel distance or pitching distance would be impaired. However, the depressions provide a turbulent airflow factor, particularly when spin is provided as illustrated in FIG. 8. The depressions apparently form trips causing the boundary air layer next to the moving ball to become more turbulent (as opposed to a laminar boundary layer) reducing drag and enhancing lift effects for extending the ball's range. Moreover, the pitched baseball can more consistently reach a target area than a smooth plastic ball, or a regulation baseball either pitched by a pitching machine or which has accumulated any degree of foreign matter or is worn, since the depressions seem to stablize the ball path. The range of the ball is substantially similar to that of a conventional baseball and its range is increased by about five to seven percent over a similar plastic ball without depressions. The ball as pitched by a machine will consistently hit a six inch diameter target hole from sixty feet away.

Moreover, the ball according to the present invention provided for better gripping and less slippage in a pitching machine as hereinafter more fully described because of the better frictional surface engagement, and pitching accuracy is also increased for this reason. The orientation of the ball in the pitching machine is of no material significance as compared with a ball having seam lines, real or artifical. The ball has improved characteristics for hand pitching as well as machine pitching because of the better grip which it enables, and is quite suitable for team baseball practice particularly in wet weather whether or not a pitching machine is being employed. Even the sound of the bat hitting the ball according to the present invention is more natural or more similar to the sound of a regulation ball than is the case with other plastic balls.

The manufacture of the baseball is accomplished employing a two part mold illustrated in FIG. 3 comprising a left section 18 and a right section 20, each having a hemispherical mold cavity for forming part of the overall configuration of the desired sphere. The mold sections, which may be formed of metal, are illustrated in cross section in FIG. 7 where it is seen projections 22 extend outwardly from the mold to provide the various depressions. A mold release material may be used with the mold section. A filler hole 24 is provided, half in each of the mold sections, and is adapted to receive a plug 26. Mold section 20 includes aligning pins 21 for reception in mating apertures in section 18.

The mold sections 18 and 20 are initially clamped together as illustrated in FIG. 4 by means of clamp 27 and a filler spout 28 is inserted in hole 24, said filler spout leading from a mixer for polyurethane material, for example an Admiral 122 P mixing machine, in which quantities of part A and part B additives are mixed. It is understood a plurality of molds may be employed in a production line manner and successively receive the mixture. After filling, a plug 26 (FIG. 5) is inserted in each hole 24, such plug having a small diameter axial vent 25.

Part A in the mixture includes sixteen to seventeen percent blowing agent which is preferably freon, but which may comprise another fluorocarbon, to aid in proper cell formation, together with approximately 0.1 percent surfactant which comprises a silicone and in particular a dimethyl silicone polymer, and with the remainder of part A being a polymeric isocyanate. Part B comprises approximately 0.5 percent amine catalyst, 0.1 percent wetting agent or surfactant (dimethyl silicone polymer) so that surface tension is controlled to disrupt cells on the surface for self-skinnning or production of the surface skin, and the remainder comprising polyol, i.e. polyether. Parts A and B are mixed in the aforementioned mixing machine and substantially immediately supplied to the mold, with the proportion of part B to part A preferably being in the ratio of sixty-one to thirty-nine. In the preferred case, component A was a system number 977-C-258 and component B was a system number 977-C-648, both manufactured by the Cook Paint and Varnish Company of Kansas City, Mo. In the finished ball, this formulation provided a Shore durometer scale A-2 hardness of 75.5 and the ball rebounded to a height of thirty-eight inches when dropped from ten feet, or a rebound of thirty-two percent. The density of the material was 43.5 pounds per cubic foot with the ball weighing between 145 and 150 grams. It should be noted that the material is resilient and tough in the finished ball, freon or similar fluorocarbon agent, which is not reactive in the system, being employed for a blowing agent rather than water which would produce a large proportion of urea groups and greater rigidity. The heat of exotherm of the reaction "boils" the freon and produces the cellular structure in the ball according to the present invention, and therefore the freon is preferred.

By way of further example, the same part A and part B constituents as hereinbefore described were mixed in a proportion of B to A of sixty-five to thirty-five resulting in a ball which rebounded thirty-eight inches when dropped from a height of ten feet, or thirty-two percent. The Shore durometer hardness was fifty-four and the density was forty-two pounds per cubic foot.

In another example, the proportion of part B to part A was sixty to forty resulting in a rebound of thirty-seven inches when dropped from the same height, or thirty percent, while the hardness was seventy-five and the density 43.5 pounds per cubic foot.

In a further example, the ratio of part B to part A was fifty-five to forty-five resulting in a rebound of thirty-four inches or twenty-eight percent, a Shore durometer hardness of eighty-five and a density of forty-four pounds per cubic foot.

In another instance, the proportion of part B to part A was fifty to fity resulting in a rebound of thirty-one inches or twenty-six percent, a Shore durometer hardness of ninety-two and a density of forty-five pounds per cubic foot. This formulation is generally not considered satisfactory for the baseball application, but indicates the physical characteristics for a mixture having a greater percentage of part A. On the other hand, for a much higher ratio of part B to part A, for example seventy to thirty, the hardness and bounce are drastically reduced to the unsatisfactory point. The ratio of B to A in the area of about sixty to forty is preferred from the standpoint of desirable properties.

The mixture cures in the mold for ten to fifteen minutes, after which clamp 27 is removed and the mold sections are separated. The polyurethane sphere is removed from the mold sections with comparative ease because of the resilience of the material and no tearing results despite the fact that projections 22 protrude into the sphere. Thus, the resilience of the material makes an easy molding process possible and provides a tougher ball. As can be seen, the ball is formed economically of homogeneous material in a single molding operation. Moreover, the material of which the ball is formed is "virgin" or newly formed material which enhances the lift of the ball as compared, for example, with balls containing filler material.

FIG. 8 illustrates a pitching machine suitable for propelling a ball according to the present invention, said pitching machine being more fully described in the aforementioned Smith application Ser. No. 850,472. The pitching machine, 32, includes a tripod stand comprising legs 34 secured to a lower metal casting 35 provided with a lower conical skirt 36 for receiving the legs. A T-shaped handle 37 tightens the legs in place. Casting 35 also supports a control panel box 38 adapted for adjusting the speed of the ball engaging wheels 48 and 50.

Casting 35 includes an upper, flat-sided ear portion 40 to which upper metal casting 42 is adjustably secured so that the casting 42 may be tilted upwardly or downwardly relative to ear 40 of casting 35 for determining the initial trajectory angle of the ball. Handle 44 is used in making this adjustment, said handle being attached to a connecting pipe 46 which is secured to casting 42.

Casting 42 includes bearing members for shafts of the ball engaging wheels 48 and 50, and supports motors (not shown) for rotating the ball engaging wheels in opposite directions under the control of panel box 38. Each of the wheels includes a rigid central hub portion, 54 and 56 respectively, of cast aluminum suitably having a flat cylindrical rim about ten inches in diameter for supporting a body or tire of elastomeric material, 58 and 60 respectively. The bodies of elastomeric material are grooved for receiving and channeling a ball. A chute 52 is mounted for receiving ball 10' and directing the same between the grooved peripheries of the two wheels.

The speed of the respective motors driving wheels 48 and 50 is adjustable and by simultaneously increasing the speed of both motors, the speed with which the ball is projected can be increased. Generally, the speed of wheel 50 is adjusted to be greater than the speed of wheel 48 whereby to provide spin on the baseball as illustrated by the arrow under ball 10'' to increase the pitching distance of the ball. At a typical pitching speed of fifty-seven to sixty miles per hour the spin imparted is approximately 3000 r.p.m., and at a pitching speed of sixty-two to sixty-five miles per hour, the spin is desirably about 3800 r.p.m. With the ball according to the present invention having the hereinbefore described depressions, the spin thus imparted is more effective in increasing the range and accuracy of the ball than would be the case, for example, if a smooth plastic sphere were to be employed. As hereinbefore described, range is increased by approximately five to seven percent and the ball will consistently hit a six inch diameter target hole from sixty feet away, even after extended use and wear and with the ball in a somewhat soiled condition. The depressions in the ball thus enable the ball to be made with greater resilience and toughness and hence durability since the depressions enable the resilient ball to travel as far and with as much accuracy as a harder and less durable ball. The exterior of the ball is uniform overall and therefore is not sensitive to the orientation with which it is fed between wheels 48 and 50, as opposed to a seam ball wherein one of the wheels may engage a seam and throw it one way or the other. The exterior surface of the ball according to the present invention, because of its overall "roughness", is engaged more securely between the machine pitching wheels and pitched in a more certain direction.

FIG. 9 illustrates a baseball batting range employing a plurality of side-by-side pitching machines, one of which is illustrated at 32. The batting range structure is illustrated in cross section and includes a floor 62 which is suitably formed of concrete and slopes toward a cylindrical sump or well 64 located to the rear of the pitching machines. The top or roof 68 of the structure need not be solid, for example, it may be formed of netting or screening to insure containment of struck baseballs. Adjacent the sidewall 70 of the structure are a plurality of pitching booths which may be arranged in line or in part of a semicircle in front of the respective pitching machines, one such booth being illustrated at 72. Each booth contains a "home plate" 74 across which a corresponding pitching machine is designed to pitch a ball via path 88.

After a baseball pitched by one of the machines is struck by a batter, the same will eventually roll down the sloped floor toward sump 64. The balls gathered in sump 64 are moved onto an inclined conveyor 32 by means of an agitator 66, and up the conveyor to a ball distribution hopper 78 supported on legs 80 and containing an agitator 82. The ball distribution hopper is elevated on legs 80 with respect to the pitching machines and agitator 82 distributes the balls to a plurality of downwardly extending tubes such as tube 84 having an inside diameter greater than the outside diameter of a baseball. A plurality of baseballs can be held in each tube in magazine fashion for supply to the corresponding pitching machine, a metering device 40 being located proximate the lower end of each tube for selective operation to release one ball at a time to the associated pitching machine.

It will be appreciated the balls are constantly batted and reused after they are collected and reconveyed to the respective pitching machines. The balls are apt to become worn, not only from batting and rolling on the concrete floor, but from being continuously conveyed through various mechanical means. Unless the floor is quite clean, the balls will pick up foreign matter or dirt which in the case of ordinary balls might affect the accuracy with which they can be pitched. Moreover, conventional balls having leather covers or the like are somewhat more difficult to convey and may stick in tubes 84 due to inter-ball friction or friction between the ball and the tubes. However, the balls according to the present invention can be conveyed without sticking.

The importance of consistently pitching to the strike zone can be seen when it is realized the individual entering the batting booth, after having deposited coins in a coin operated switch for starting the operation of the pitching machine, may even be a complete amateur as far as the game of baseball is concerned. If the ball is pitched continuously across home plate the batter will be safe from being struck by a ball if normal caution is exercised. Also, the ball should, of course, arrive at a predictable distance above home plate.

Moreover, not only when pitching the ball, but also in batting the same, it is desired to provide a realistic travel distance comparable to that of a regulation baseball. Balls as may be used in a batting range with a pitching machine should be interchangeable and have travel characteristics comparable to a good regulation ball. These qualifications are consistently met with by the ball according to the present invention because of its predictable and extended travel path which is maintained with ball wear, while at the same time offering the properties of durability.

Although a baseball has been generally described herein, it is understood this language is also intended to comprehend a softball.

While we have shown and described a preferred embodiment of our invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. A resilient baseball having properties of improved durability and pitching accuracy over the period of use and otherwise exhibiting the characteristics of a regulation baseball, comprising:

a molded, resilient polyurethane foam sphere of homogeneous composition and density throughout its cross section and having an interior cellular structure characterized by a multiplicity of gas enclosing cells, said sphere having a type A-2 shore durometer hardness of less than about eighty to eighty-five, said sphere having a smooth polyurethane surface skin, the surface of said sphere being provided with a regular surface pattern comprising a multiplicity of cup-like depressions, each of which is small in diameter as compared with the diameter of said sphere, said depressions substantially covering the exterior surface of said sphere such that the spacing between depressions is comparable to the diameter of said depressions to present substantially the same aspect of surface depression configuration for any direction of travel of said sphere through the air, said smooth surface skin extending into said depressions.

2. The baseball according to claim 1 formed of polyurethane foam having a durometer hardness of approximately seventy-five.

3. The baseball according to claim 1 wherein said depressions are semi-spherical in shape, having a depth equaling about half the diameter thereof.

4. The baseball according to claim 1 wherein said depressions are spaced on the surface of said sphere such that the distance between depression perimeters is between a fraction and twice the diameter of said depressions.

5. The baseball according to claim 1 having a diameter between two and seven-eighths inches and three inches.

6. The baseball according to claim 1 wherein said depressions are arrayed in regular rows about said sphere.

7. The baseball according to claim 1 where the total number of depressions on said sphere is between two hundred and four hundred.

8. The baseball according to claim 1 wherein when the total number of depressions on said sphere is on the order of two hundred and eighty-six.

9. The baseball according to claim 1 where the depression diameter is on the order of one-tenth to one-twentieth the diameter of the baseball, and the depth of said depressions is on the order of one-twentieth to one-fortieth the diameter of said baseball.

10. The baseball according to claim 1 wherein the diameter of said depressions is between 0.075 and 0.125 inches.

* * * * *

UNITED STATES PATENT AND TRADEMARK OFFICE

CERTIFICATE OF CORRECTION

PATENT NO. : 4,256,304

DATED : March 17, 1981

INVENTOR(S) : TOMMY L. SMITH, ET AL.

It is certified that error appears in the above—identified patent and that said Letters Patent is hereby corrected as shown below:

Column 5, line 2, "in" should be --is--.

Column 5, line 20, "stablize" should be --stabilize--.

Column 5, line 28, "provided" should be --provides--.

Column 6, line 52, "fity" should be --fifty--.

Column 7, line 8, "lift" should be --life--.

Column 10, line 3, "of" (second occurrence) should be --for--.

Signed and Sealed this

*Sixteenth* Day of *February 1982*

[SEAL]

*Attest:*

GERALD J. MOSSINGHOFF

*Attesting Officer*

*Commissioner of Patents and Trademarks*